United States Patent [19]

Kobayashi et al.

[11] Patent Number: 4,986,181

[45] Date of Patent: Jan. 22, 1991

[54] ROLLERS FOR A LITHOGRAPHIC INK SUPPLYING SYSTEM

[75] Inventors: Toshiro Kobayashi, Toyohashi; Hisashi Hiraishi, Tsuzuki; Makoto Hineno, Hirakata; Tomoshi Kawata, Yokohama; Yuuji Kohara, Kodaira; Masaharu Saito, Hatano, all of Japan

[73] Assignees: Kubota Ltd., Osaka; Kabushikigaisha Tokyo Kikai Seisakusho, Tokyo, both of Japan

[21] Appl. No.: 197,575

[22] Filed: May 23, 1988

[30] Foreign Application Priority Data

May 27, 1987 [JP] Japan ..... 62-130743

[51] Int. Cl.[5] ..... B41F 31/26

[52] U.S. Cl. ..... 101/348; 29/132

[58] Field of Search ..... 101/348, 349, 350, 147, 101/148; 29/132

[56] References Cited

U.S. PATENT DOCUMENTS

| | | | |
|---|---|---|---|
| 3,617,358 | 11/1971 | Dittrich | 427/423 |
| 3,655,425 | 4/1972 | Longo | 75/27 |
| 4,009,658 | 3/1977 | Heurich | 101/348 |
| 4,301,730 | 11/1981 | Heurich et al. . | |
| 4,537,127 | 8/1985 | Fadner | 101/141 |
| 4,567,827 | 2/1986 | Fadner | 101/350 |
| 4,601,242 | 7/1986 | Fadner | 101/348 |
| 4,860,652 | 8/1989 | Kawata | 101/348 |

FOREIGN PATENT DOCUMENTS

| | | | |
|---|---|---|---|
| 60-44394 | 3/1985 | Japan | 101/348 |
| 61-114852 | 6/1986 | Japan . | |

*Primary Examiner*—Clifford D. Crowder

*Attorney, Agent, or Firm*—Foley & Lardner, Schwartz, Jeffery, Schwaab, Mack, Blumenthal & Evans

[57] ABSTRACT

A roller for use in lithography which comprises a surface layer of finely and uniformly mixed ultra-hard material and lipophilic material. The ultra-hard material is preferably tungsten carbide-cobalt and the lipophilic material is preferably aluminum bronze casting, the aluminum bronze casting being mixed with the tungsten carbide-cobalt in the ratio of 25–40% by weight.

5 Claims, 4 Drawing Sheets

ROLLERS FOR A LITHOGRAPHIC INK SUPPLYING SYSTEM

BACKGROUND OF THE INVENTION (1) Field of the Invention

The present invention relates to rollers for a lithograph and producing method of these rollers. More particularly, the present invention relates to rollers assembled in an ink supplying system of the lithograph, which uses ink and water, to perform ink distributing and excess ink removing works in addition to an ink supplying work. Further, the present invention relates to rollers which are auxiliarily used to ensure ink-supplying at a constant rate, and the rollers subjected to be contacted with a doctor blade.

(2) Description of the Prior Art

Such type rollers have been provided by following prior arts.

(A) Japanese Patent Application Laid-Open Publication No. 58-42463,

"Mesh Roller for an Offset Printing"

(B) Japanese Patent Application Laid-Open Publication No. 58-56855,

"Mesh Roller for an Offset Printing"

(C) Japanese Patent Application Laid-Open Publication No. 58-56856,

"Mesh Roller for an Offset Printing"

(D) Japanese Patent Application Laid-Open Publication No. 59-204558,

"Mesh Roller for a Lithograph"

(E) Japanese Patent Application Laid-Open Publication No. 61-68250,

"Ink Supplying Roller with Mesuring, and the Producting Method of the Roller and Ink Applying Apparatus"

(F) Japanese Patent Application Laid-Open Publication No. 61-181645,

"Ink Measuring Roller for a Lithograph"

(G) Japanese Patent Application Laid-Open Publication No. 61-181646,

"Ink Measuring Roller for a Lithograph"

(H) US. Patent Publication No. 4,301,730,

"ANILOX ROLL AND METHOD OF MAKING THE SAME"

(I) Japanese Patent Application Laid-Open Publication No. 60-44394,

"Ink Roller"

Further, the non-opened prior arts provided by the same applicant of the invention are as follows.

(J) Japanese Patent Application No. 60-187148,

"Mesh Roller for a Lithograph"

(K) Japanese Patent Application No. 61-119901,

"Mesh Roller and Method of Making the Same"

(L) Japanese Patent Application No. 61-126686,

"Mesh Roller for a Lithograph"

(M) Japanese Patent Application No. 61-68084,

"Roller"

The above listed prior arts will be briefly described.

The reference (A) entitled "Mesh Roller for an Offset Printing" relates to a mesh roller whose protruded sections are plated with a high anti-abrasive material and recessed sections are plated with an lipophilic material, wherein the lipophilic material is copper as a typical example, and the high anti-abrasive material is chromium as a typical example.

The reference (B) entitled "Mesh Roller for an Offset Printing" relates to (a) a mesh roller whose uneven surface is coated with a chromium layer, the surface layer of which is formed in a porous structure and soaked with oil to form a lipophilic layer, and (b) a mesh roller whose uneven surface is coated with a ceramic layer, pin holes formed in which are soaked with oil to form a lipophilic layer.

The reference (C) entitled "Mesh Roller for an Offset Printing" relates to (a) a mesh roller formed with a beryllium-copper layer by a plasma deposition whose surface layer is formed in a mesh shape uneveness and hardened by a heat treatment, and (b) a mesh roller formed with a beryllium-copper layer by a plasma deposition whose surface layer being formed in a mesh shape, and hardened by a heat treatment, and the protruded sections of the uneven surface are only plated with chromium.

The reference (D) entitled "Mesh Roller for a Lithograph" relates to (a) a mesh roller comprising a steel base whose surface is formed with a hardened layer and whose recessed sections are plated with a lipophilic material, (b) a mesh roller comprising a steel base whose surface is formed with a hardened layer by a nitriding treatment and whose recessed sections are plated with a lipophilic material, (c) a mesh roller comprising a steel base whose surface is formed with a hardened layer having a Vickers hardness of at least 1000 Hv by a nitriding treatment and whose recessed sections are plated with a lipophilic material, (d) a mesh roller comprising a steel base whose surface is formed with a handened layer and whose recessed sections are plated with copper as a lipophilic material, and (e) a mesh roller comprising a steel base whose surface is formed with a hardened layer and whose recessed sections are plated with copper by a process including a first step for plating over all surface and second step for removing the plated layer from the projected sections.

The reference (E) entitled "Ink Supplying Roller with Mesuring, and the Producing Method of the Roller and Ink Applying Apparatus" relates to an ink supplying roller with measuring whose steel base is formed with a nitrized inner layer having a Rockwell hardness of at least 55 Rc whose thickness is 3 mils or more, and a fine porous oxized outer layer composed of $Fe_3O_4$.

The reference (F) entitled "Ink Measuring Roller for a Lithograph" relates to an ink measuring roller whose surface is plated with a electroless nickle layer having a Rockwell hardness of at least 50 Rc and a copper layer on the nickle layer.

The reference (G) entitled "Ink Measuring Roller for a Lithograph" relates to (a) an ink roller whose surface is wholly covered with a lipophilic material layer and further formed with a porous ceramic layer, (b) an ink roller whose surface is wholly covered with copper layer as a lipophilic material and further formed with a porous ceramic layer, (c) an ink roller whose surface is wholly covered with a lipophilic material layer and further formed with a porous ceramic layer composed of aluminum oxide ($Al_2O_3$), and (d) an ink roller whose serface is wholly covered with copper layer as a lipophilic material and futher formed with a porous ceramic layer composed of aluminum oxide ($Al_2O_3$).

Following references teach rollers coated with ceramics.

The reference (H) entitled "ANILOX ROLL AND METHOD OF MAKING THE SAME" relates to a mesh roller whose surface is coated with a ceramic layer by a melt injection coating and further coated with a polymer sealing material to seal the pores in the ceramic layer.

The reference (I) entitled "Ink Roller" relates to a roller whose steel surface is coated with a porous ceramic layer by a melt injection coating and further coated with a lipophilic resin to seal the pores in the ceramic layer.

Following references provided by the same applicant of this invention teach mesh rollers for an offset printing.

The reference (J) entitled "Mesh Roller for Offset Printing" relates to (a) a mesh roller whose steel surface is wholly coated with a ceramic layer and further plated with a lipophilic material, and (b) a mesh roller whose steel surface is wholly coated with a ceramic layer and further plated with a lipophilic material to form the even surface where the ceramic material and the lipophilic material are finely mixed.

The reference (K) entitled "Mesh Roller and Method of Making the Same" relates to (a) a mesh roller whose each projected section includes a center section composed of a mother material of the roller which has ink philic and hydrophobic properties, and an edge section of the projected section composed of a surface layer of recessed section which is harder than the mother material, (b) a mesh roller defined by (a) whose recessed surface layer is further coated with a material having ink philic and hydrophobic properties, (c) a mesh roller defined by (a) and (b) whose mother material is composed of copper or copper alloy, and recessed surface layer is composed of ceramic, and (d) a mesh roller defined by (a), (b) and (c) whose mother material is provided with a pre-plating layer.

The reference L) entitled "Mesh Roller for Lithograph" relates to (a) a mesh roller whose steel surface is wholly coated with an ultra-hard material and further coated or plated with a lipophilic material, (b) a mesh roller whose steel surface is wholly coated with an ultra-hard material and further coated or plated with a lipophilic material to form the whole surface except for the recessed sections where the ultra-hard material and the lipophilic material are finely mixed, (c) a mesh roller whose steel surface is wholly coated with the mixture of ultra-hard material and lipophilic material to form a surface layer with finely mixed of them, (d) mesh rollers defined by (a), (b), and (c) wherein the ultra-hard material is selected from ceramics, (e) mesh rollers defined by (a), (b), and (c) wherein the ultra-hard material is tungsten carbide, (f) mesh rollers defined by (a), (b), and (c) wherein the lipophilic material is copper, and (g) mesh rollers defined by (a), (b), and (c) wherein the lipophilic material is copper alloy.

Following reference provided by the same applicant of the invention teaches a roller for a rotary press.

The reference (M) entitled "Roller" relates to (a) a roller whose surface is provided with continuous or non-continuous belts made of high anti-abrasive material which are arranged to méet at non-right angle with the axis of the roller, (b) a roller defined by (a) wherein the belts are made of the same material as the roller mother material, (c) a roller defined by (a) wherein the belts are made of a high hard material, (d) a roller defined by (a) wherein the belts are made of ceramics, (e) a roller defined by (a) wherein the belts are made of tungsten carbide, (f) a roller defined by (a) wherein the surface except for the belts are made of the same material as the roller mother material, (g) a roller defined by (a) wherein the surface except for the belts is made of a lipophilic material, (h) a roller defined by (a) wherein the surface except for the belts is made of copper or cpper alloy as a lipophilic material, (i) a roller defined by (a) wherein the surface except for the belts are made of a hydrophilic material, (j) a roller defined by (a) wherein the surface except for the belts is made of chromium as a hydrophilic material, (k) mesh roller defined by (a), (b), (c), (d), (e), (f), (g), (h), (i) and (j) whose surfaces are formed with a regular arrangement of fine cells for measuring, and (1) mesh rollers defined by (a), (b), (c), (d), (e), (f), (g), (h), (i) and (j) whose surfaces are smooth.

The rollers for a lithgraph are required that the surface has lipophilic and hydrophobic property and a high abrasive property. These properties are not satisfied by the above mentioned references.

The references A, B, (b) of C, D, E, F, G and H disclose ink supplying rollers whose external surface is made of anti-abrasive materials such as chromium, nickle, ceramic in order to improve abrasive resistance against the abrasive motion of doctor blade. Although this constitution satisfies the purpose of improving the abrasive resistance, chromium, nickle, and ceramic may easily cause troubles during ink-supplying work because they are lipophilic but hydrophilic rather than hydrophobic. The ink on the roller surface may be replaced by water when water is mixed or remained in the ink supplying system.

The roller (a) of the reference C is provided with a copper alloy; i.e., beryllium-copper, to form a lipophilic and hydrophobic surface. Although the beryllium-copper is the hardest of copper alloys, its abrasive resistance against the doctor blade is not satisfied.

The reference I teaches a roller whose abrasive resistance is improved by use of ceramic and whose surface is provided with lipophilic and hydrophobic properties by use of a lipophilic resin. However, this roller surface is poor in workability so that fine cells can not be formed in the surface. Further, the roller surface is made of two materials; ceramic and lipophilic resin, having different thermal conductivity and thermal expansion rate. These two layers may be separated and the resin layer may be broken when the roller is alternatively subjected to the repetition of heating and cooling. Thus this roller can not be used for a long period.

SUMMARY OF THE INVENTION

Therefore, it is an object of the present invention to provide a roller for a lithograph which uses water in an ink supplying system.

Another object of the present invention is to provide a roller which can execute an ink supplying work with a constant and correct quantity by the co-operation with a blade which is in contact with the roller surface.

A further object of the present invention is to provide a roller which can assist an ink supplying work to perform another members.

A further object of the present invention is to provide a roller which is improved in durability for a long working period.

Still a further object of the present invention is to provide a making method of the roller mentioned above.

To accomplish the above objects, a roller according to the present invention comprises a mother member, and a first surface layer finely and uniformly mixed of ultra-hard material and lipophilic material. Further, a roller may be covered with an additional layer composed of liphophilic material whose external surface is further polished.

A making method of a roller according to the present invention comprises a first working step for producing a mother member of roller, a second working step for providing a plurality of cells regularly arranged in the surface of the mother member and/or a blast working on the surface, and a third working step for coating a surface layer finely and uniformly mixed of ultra-hard material and lipophilic material on the surface after the second working step.

The surface of the roller according to the present invention can be improved in its lipophilic and hydrophobic properties, and a high abrasive resistance.

Many other features, advantages and additional objects of the present invention will become manifest to those versed in the art upon making reference to the detailed description which follows and the accompanying sheets of drawings.

DETAILED DESCRIPTION OF THE PREFERRED EMBODIMENT

Figure 1:
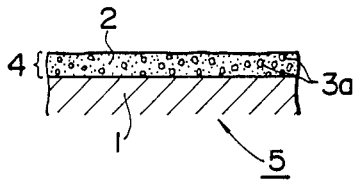
FIG. 1 through FIG. 4 are enlarged cross sectional views showing the surface of the roller according to the present invention.
Figure 2:
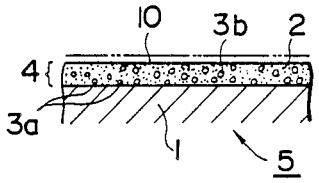
Figure 3:
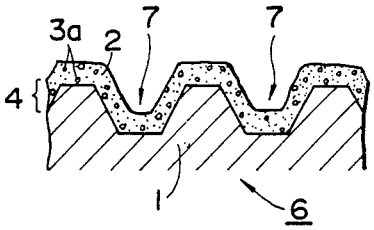
Figure 4:
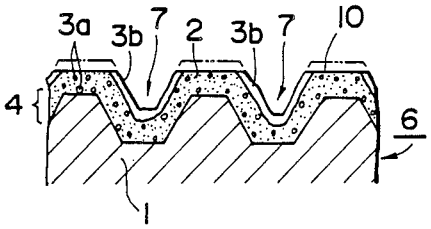

FIG. 1 and FIG. 2 show enlarged cross sectional views of the surface of a meshless roller 5 without measuring cells. FIG. 3 and FIG. 4 also show enlarged cross sectional views of the surface a mesh roller 6 with measuring cells.

Each surface of the meshless and mesh rollers 5 and 6 comprises a mother member 1 and an external layer 4 coated on the mother member 1. The external layer 4 includes ultra-hard material 2 and lipophilic material 3*a* which are finely and uniformly mixed each other. alternatively, the external layer 4 is additionally coated with an additional lipophilic material 3*b* and further polished to form the surface having lipophilic and hydrophobic properties with extremely high hardness.

Figure 5:
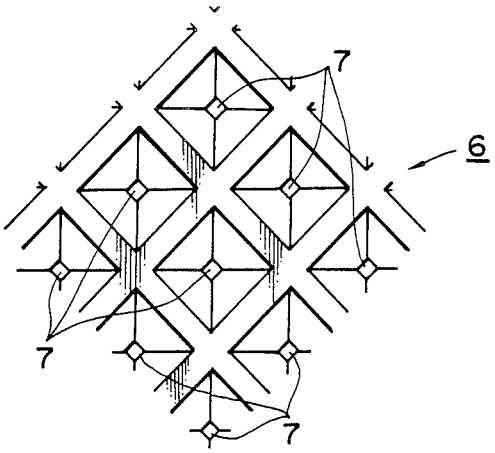
FIG. 5 is a schematic illustration showing one example of cell configuration formed in the roller surface according to the present invention.
Figure 6:
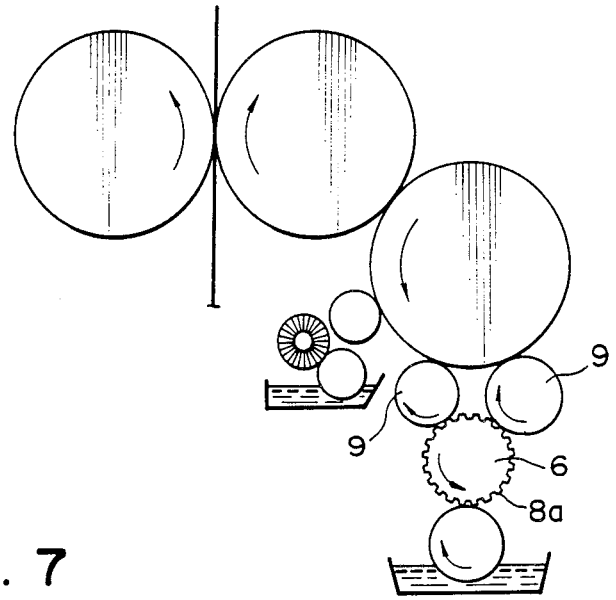
FIG. 6 is a schematic illustration showing an overall view of keyless offset compact type printing device in which the roller according to the present invention is arranged.
Figure 7:
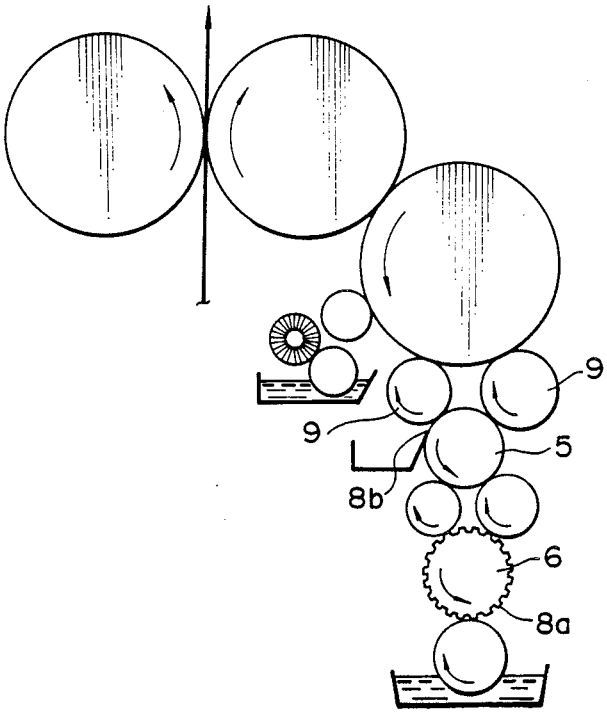
FIG. 7 is a schematic illustration showing an overall view of ink supplying system in which the roller according to the present invention is arranged.

The mesh roller 6 is provided with a plurality of measuring cells 7 regularily arranged in its surface as shown in FIG. 3 and FIG. 4. In an offset printing apparatus using water, the mesh roller 6 is arranged in the upper stream of an ink supplying system as shown in FIG. 6 and FIG. 7. The mesh roller 6 is in contact with a doctor blade 8*a* to execute ink supplying work with an essentially constant amount of ink contained in the measuring cells 7 enlarged shown in FIG. 5.

The meshless roller 5 is arranged adjacent to former rollers 9 in an ink supplying system shown in FIG. 7 and in contact with a second doctor blade 8*b* to assist the regular ink supplying work with measuring and removing uneven or excess ink layer.

The ultra-hard material 2 for the external layer 4 is selected from composite ceramics or ultra-hard alloy particles, and the lipophilic material 3 is selected from copper alloy or copper particles. These particles are uniformly dispersed and partially melted and solidified. Finally they are combined and engaged in a complicated form.

Further, the external layer 4 may be selected from the combination of tungsten carbide-cobalt (WC-Co) particles for the ultra-hard material 2 and aluminium bronze casting (AlBC) particles for the lipophilic material 3. This combination layer may provide superior abrasive resistance, lipophilic and hydrophobic properties. For example, this combination layer is substantially five times as strong as the combination of tungsten carbide-cobalt (WC-Co) particles and copper particles. Both the combinations provide essentially similar degree with respect to lipophilic and hydrophobic properties. They are inferior to a single layer of aluminium bronze casting (AlBC), but applicable to printing work with no-troubles. Variations of such composition may provide more superior effect. For instance, the best result may be provided when the combination of WC-12Co and Cu-10Al-5Ni-5Fe is in the weight ratio of 75:25 to 60:40.

Figure 8:
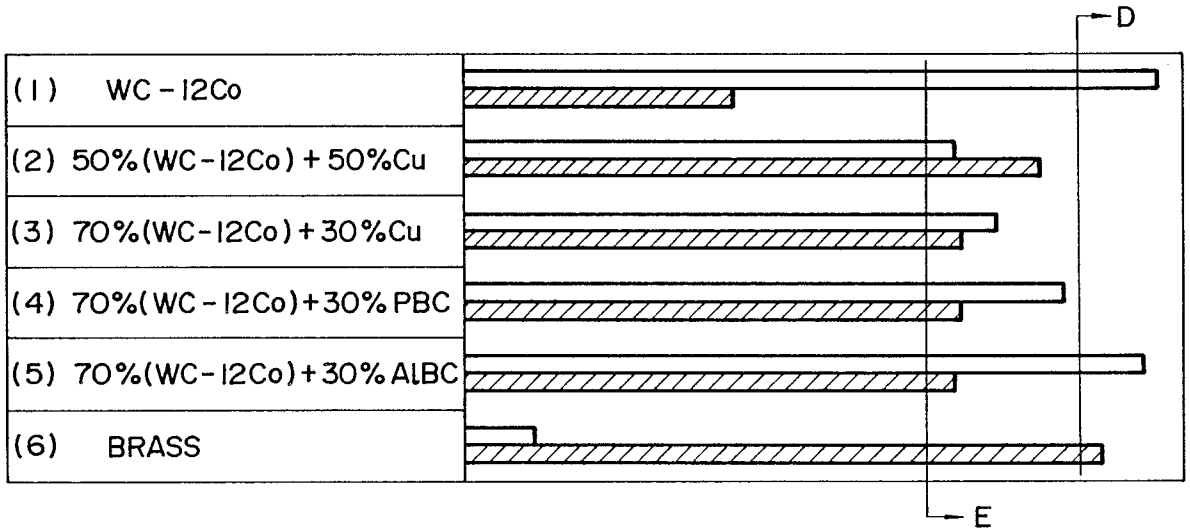
FIG. 8 is a graphic table representing the relation between the abrasive resistance of each material and its contact angle with water and FIG. 9 is a graph representing the relation between abraded degree and contact angle with water according to the change of aluminum bronze casting (AlBC) containing ratio.

FIG. 8 is a graphic table representing the relation between the abrasive resistance of each composition and its contact angle with water. The composition (1) is a single material of tungsten carbide-cobalt (WC-12Co), the composition (2) is a mixture of tungsten carbide-cobalt (WC-12Co) 50% and copper 50%, the composition (3) is a mixture of tungsten carbide-cobalt (WC-12Co) 70% and copper 30% the composition (4) is a mixture of tungsten carbide-cobalt (WC-12Co) 70% and phosphor bronze casting (PBC) 30%, the composition (5) is a mixture of tungsten carbide-cobalt (WC-12Co) 70% and aluminium bronze casting (AlBC ;ie., Cu-10Al-5Ni-5Fe) 30%, and the composition (6) is a single material of brass.

In FIG. 8, white bars represent abraded degree of each material, with the longest bars indicating the least abraded materials The white bars longer than the line D represent desirable results for printing work. The shadow bars represent contact angle of each material with water, with the longer bars indicating the longer contact angles. The shadow bars longer than the line E represents desirable results for printing work. As is clear from FIG. 8, the composition (5); i.e., the mixture of tungsten carbide-cobalt (WC-12Co) 70% and aluminium bronze casting (AlBC) 30% provides the best result.

Figure 9:
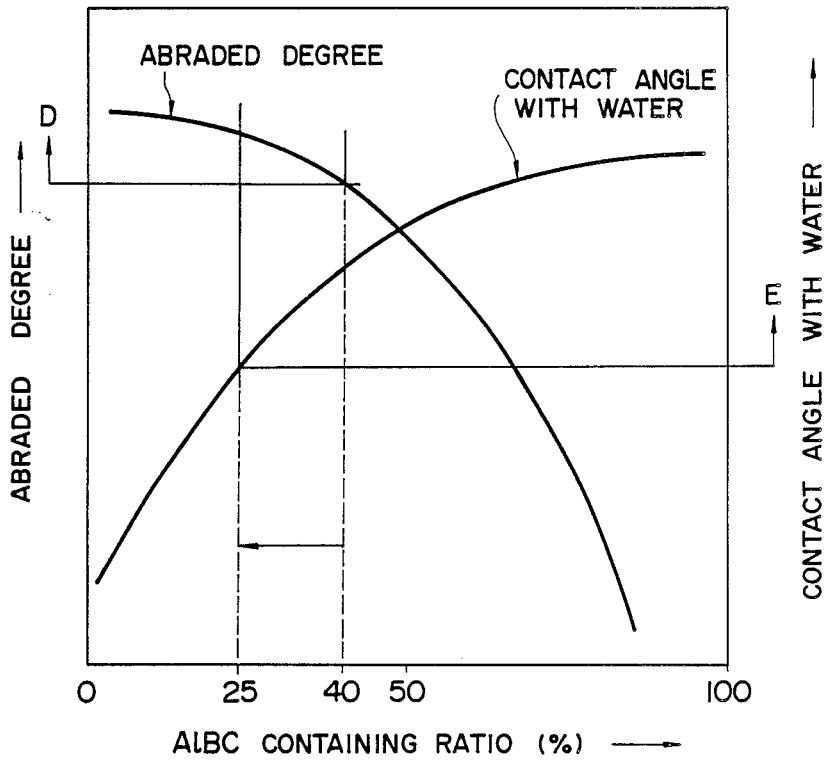

FIG. 9 shows the relation between the change of abraded degree and contact angle, and the change of AlBC containing ratio of the composition WC-12Co as tungsten carbide-cobalt material and Cu-10Al-5Ni-5Fe as aluminium bronze casting (AlBC). Preferable result indicate larger than the lines D and E. As is clear from this graph, AlBC containing ratio in the range between 25 and 40% provides the best result.

The additional lipophilic material 3*b* additionally coated on the external layer 4 is preferably selected from metals having excellent heat conductivity. With consideration of lipophilic and hydrophobic properties, copper or copper alloys are most desirable. The excellent heat conductivity allows heat to radiate from the external layer 4 through the additional layer 3*b* to prevent the contact surface between them from separating by the temperature difference generated therebetween. The roller surface coated with the additional lipophilic layer 3*b* is further subjected to a surface polishing work. The measuring cells 7 of the mesh roller 6 are not polished and thus they are familiar with ink. On the other hand, the polished surface covers fine pores in the external layer 4 as shown in FIG. 2 and FIG. 4, so that the polished surface contributes to decrease the abrasion of the doctor blades 8*a*, 8*b* co-operated with the mesh roller 6 and meshless roller 5 in addition to the improvement in lipophilic and hydrophobic properties.

The additional lipophilic layer 3*b* should be polished off from the surface level represented by the phantom line to the solid line 10 as shown in FIG. 2 and FIG. 4 because, the lipophilic layer 3*b* has a poor abrasive resistance and is easily abraded by the doctor blades 8*a*, 8*b*. This polishing work is effective to prevent the lipophilic and hydrophobic properties of the roller surface from changing. The materials which remain after polishing work form the lipophilic layer A method for making the roller according to the present invention will be described.

A first step is a mother member making work. The mother member 1 is made of steel by well known method. Following to the first step, the mother member 1 is subjected to a surface treating work. In order to make the meshless roller, the roller surface is applied with a blast work to rough the surface. This blast worked surface is facilitate to adhere with the external surface 4 by a coating work, described later.

In order to make the mesh roller with the measuring cells 7, the roller surface is subjected to a cell forming work prior to the blast work to form measuring cells 7 in a regularly configuration. The blast work is optionally applied to the cell-formed surface as required. The cell forming work is selected from a rolling work which forms cells by pressing a base pattern onto the roller surface, an engraving work such as a heliograph, and a melting work using a laser beam.

After the cell forming work, the roller surface is coated with the external surface layer 4. A plasma flame spray or otlor thermal coating techniques is preferable to coat the layer for reason of the strength of the surface to be coated and/or easiness of working. The plasma flame spray or otlor thermal coating techniques may employ the mixture of particles of ultra-hard material 2 and particles of lipophilic material 3; i.e., tungsten carbide-cobalt (WC-Co) particles and aluminium bronze casting (AlBC) particles, or the sintered particles of the mixture which are produced by that the mixture is once sintered and the sintered mixture is ground into particles.

In order to form an eveness of the coating surface, an additional surface treatment is required to remove protruded sections from the coating surface.

The external surface layer 4 is further coated with a lipophilic material 3*b*. In this coating work, the lipophilic material 3*b* is formed on the external surface layer 4 by a coating in the same manner as the above work or a plating work if the lipophilic material 3*b* can be used for plating. Generally, a plating work is preferable for reason that the lipophilic layer 3*b* is so thin as to provide lipophilic and hydrophobic properties onto the external surface layer 4.

After coating work, the roller 1 is finally subjected to an abrasing and polishing work to form a smooth surface where the external surface layer 4 is partially exposed and the mixed state of the exposed external surface layer 4 and the lipophilic layer 3*b* are appeared as shown in FIG. 2 and FIG. 4.

As given explanation above, the roller according to the present invention can prevent the ink supplying system of printing apparatus from trouble caused by water, and reduce the abrasion owing to the doctor blade which is in contact with the roller. Thus, this roller allows the ink supplying system to perform its ink supplying operation with a constant amount for a long period. This can improve printing properties and save papers and inks.

Further, the mesh roller with measuring cells according to the present invention is improved in its abrasive resistance, so that the roller can elongate its exchange interval. When the mesh roller is assembled in a keyless offset compact type printing apparatus with reducing ink supplying rollers from ink supplying system shown in FIG. 6, printing work with the same ink can be repeated for a long period. In prior art rollers, such work may easily cause troubles owing to water. The use of this mesh roller removes the necessity of skillful operator from the printing work, so that printing cost and operators can be reduced.

As many apparently widely different embodiments of this invention may be made without departing from the spirit and scope thereof, it is to be understood that the invention is not limited to the specific embodiments thereof except as defined in the appended claims.

What is claimed is:

1. A roller for lithography comprising a hydrophobic surface layer finely and uniformly mixed of ultra-hard material and lipophilic material, and an additional lipophilic layer coated on said surface layer; wherein said surface layer comprises aluminum bronze casting finely and uniformly mixed in the ratio of 25–40% by weight with tungsten carbide-cobalt.

2. The roller according to claim 1, wherein said lipophilic material is aluminum bronze casting.

3. The roller according to claim 1, further comprising a plurality of recessed cells regularly arranged in said surface layer and at least one of the recessed surfaces of said cells being made of lipophilic material.

4. A roller for lithography comprising a roller coated with a surface layer comprising aluminum bronze casting finely and uniformly mixed in the ratio of 25–40% by weight with tungsten carbide-cobalt.

5. The roller according to claim 4, further comprising an additional layer coated on said surface layer and a plurality of cells regularly arranged in said surface layer.

* * * * *